US006629389B1

(12) United States Patent
Rust

(10) Patent No.: US 6,629,389 B1
(45) Date of Patent: Oct. 7, 2003

(54) SECURITY ANCHORING DEVICE

(76) Inventor: Marcus D. Rust, 5438 S.R. 16, Rensselear, IN (US) 47978

( * ) Notice: Subject to any disclaimer, the term of this patent is extended or adjusted under 35 U.S.C. 154(b) by 47 days.

(21) Appl. No.: 09/845,820

(22) Filed: Apr. 30, 2001

Related U.S. Application Data

(60) Provisional application No. 60/200,849, filed on May 1, 2000.

(51) Int. Cl.[7] ..... E04H 12/20

(52) U.S. Cl. ..... 52/157; 52/155; 248/551; 248/552

(58) Field of Search ..... 52/157, 155; 40/607; 248/551, 552

(56) References Cited

U.S. PATENT DOCUMENTS

| | | | | | |
|---|---|---|---|---|---|
| 2,552,745 | A | | 5/1951 | Stanley, Sr. et al. | |
| 3,067,846 | A | * | 12/1962 | Luebkeman | 52/157 |
| 3,797,283 | A | * | 3/1974 | Honer | 52/143 |
| 4,130,957 | A | * | 12/1978 | Hampton | 40/607 |
| 4,138,806 | A | * | 2/1979 | Miller | 52/149 |
| 4,249,715 | A | | 2/1981 | Repp | |
| 4,378,650 | A | | 4/1983 | Ottoson | |
| 4,833,846 | A | * | 5/1989 | McFeetors et al. | 52/154 |
| 4,910,902 | A | | 3/1990 | Anderson | |
| 5,094,423 | A | * | 3/1992 | Almquist et al. | 248/156 |
| 5,098,057 | A | * | 3/1992 | Gran et al. | 248/156 |
| 5,113,627 | A | | 5/1992 | Jarrett, Sr. | |
| 5,207,402 | A | | 5/1993 | Berry-Tremmel et al. | |
| 5,501,086 | A | | 3/1996 | Sherlock | |
| 5,881,978 | A | | 3/1999 | Rust | |
| 6,082,697 | A | * | 7/2000 | Grunfeld | 248/156 |
| 6,263,601 | B1 | * | 7/2001 | Emert | 248/156 |

* cited by examiner

*Primary Examiner*—Carl D. Friedman
*Assistant Examiner*—Basil Katcheves
(74) *Attorney, Agent, or Firm*—Woodard, Emhardt, Moriarty, McNett & Henry LLP

(57) ABSTRACT

There is disclosed a security anchoring device attachable to a sign or the like and anchorable to the ground to prevent or discourage theft and vandalism. According to one aspect of the invention, the security anchoring device includes a coupling member mountable to a member of the sign and also mountable along the shaft of a ground anchor. The ground anchor preferably has a tool engagement portion at its distal end that allows the ground anchor to be coupled to a power tool to drive the anchor into the ground.

22 Claims, 2 Drawing Sheets

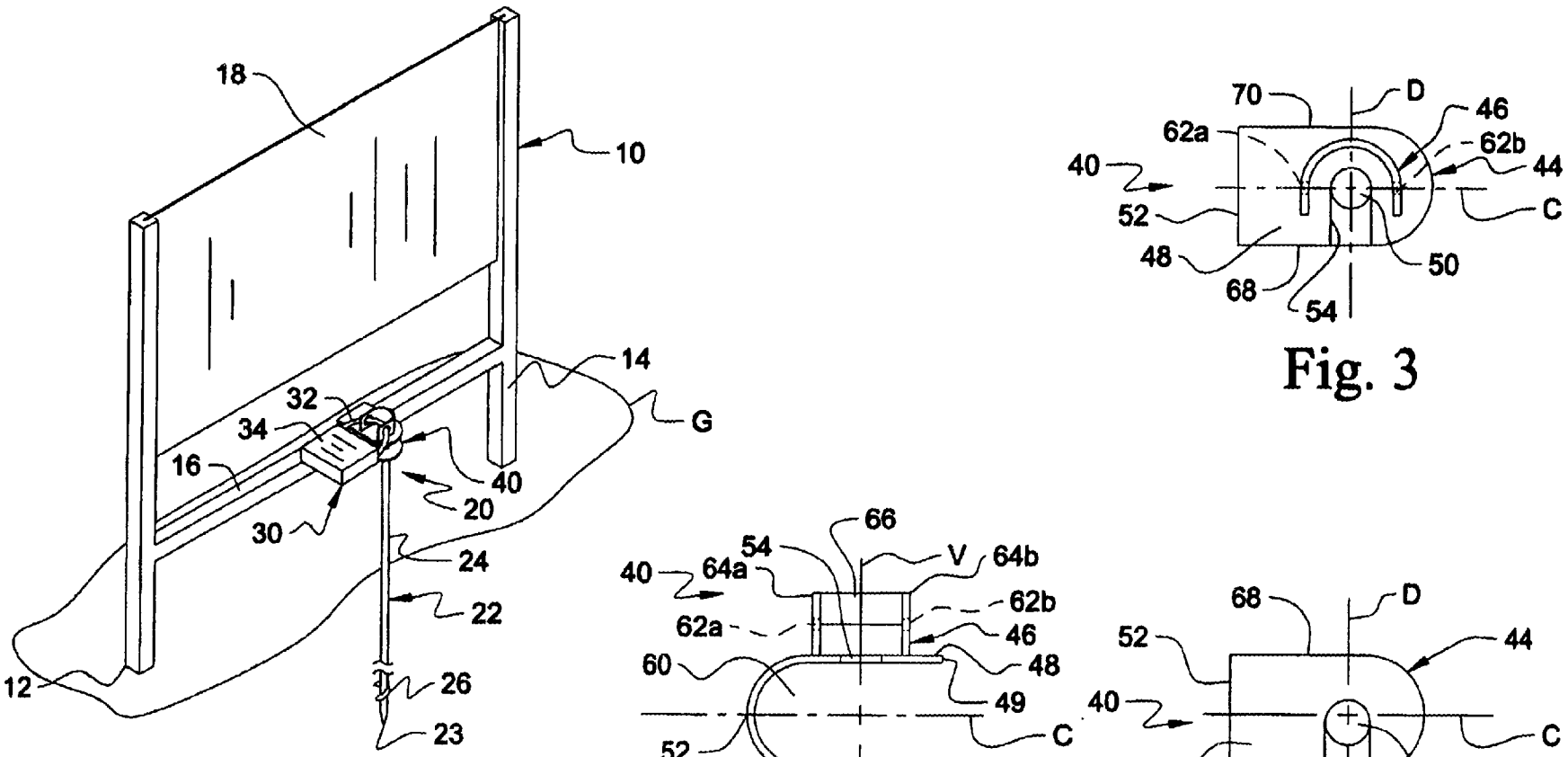
Fig. 1
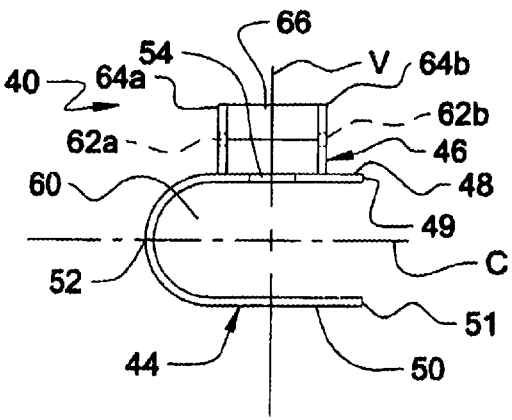
Fig. 2
Fig. 3
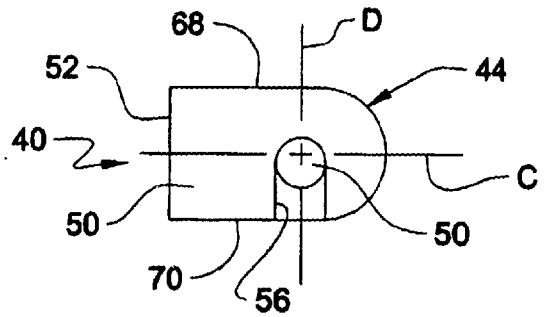
Fig. 4

SECURITY ANCHORING DEVICE

CROSS REFERENCE TO RELATED APPLICATION

The present application claims the benefit of the filing date of Provisional application Ser. No. 60/200,849 filed May 1, 2000, entitled SECURITY ANCHORING DEVICE.

FIELD OF THE INVENTION

The present invention generally relates to devices for securing objects to the ground and, more particularly, to a security anchoring device for signs and the like.

BACKGROUND OF THE INVENTION

There exist numerous prior art designs for ground anchors that are intended to discourage theft, loss, and vandalism of signs to which they are attached. These ground anchors are usually in the form of posts that are to be secured into the ground and have a portion extending above the ground that is attached to the sign. Many of these prior art devices incorporate features that make them more useful than simple stakes driven into the ground. For example, there are designs for anchors that allow a chain and/or padlock to be placed around both the sign and the anchor to secure the sign thereto with the anchor in the ground.

One specific example is provided in U.S. Pat. No. 4,130,957 to Hampton, which discloses a support frame for a sign, wherein the sign includes one post that is formed with a corkscrew that is screwed into the ground. An anchor is provided having a cork screw portion and a handle portion with a triangular opening. The handle portion is secured to a bottom cross member of the sign with a chain extending through the triangular opening and a padlock. Another example is provided in U.S. Pat. No. 5,113,627 to Jarret Sr., which discloses a sign member having an upper bridge member 24 and lower bridge member 21. The lower bridge member has an aperture 25 therethrough. An anchor member 13 includes a central shaft with a screw flight and an upper framework 16 having a lock plate 18 fixedly mounted in the framework. A torque plate 19 is mounted to and extends laterally from the framework. A lock hole 17 through lock plate 18 is alignable with the aperture of the lower bridge member to receive a lock member 26.

While such prior art devices provide desirable features, such as locking capability, there remains a need for additional improvements. For example, some prior art devices employ a framework or handle at the upper end of the anchor that requires the anchor to be gripped to apply manual force to screw the anchor into the ground. Oftentimes the ground conditions are such that the anchor cannot be easily or adequately secured to the ground using manual force. A further disadvantage is realized in some prior art devices since a particular orientation of the sign with respect to the anchor is required to attach the lock. This requires the depth of the anchor in the ground or the position of the sign to be adjusted in order to attach the lock while orienting the sign in the desired direction. Some prior art devices are not readily adaptable to many different types of signs or require modifications to the sign. For example, the device in the '627 patent requires the sign to have a lower bridge member with an aperture formed therethrough, and the device of the '957 patent contemplates that the sign is modified to provide a permanent corkscrew leg.

There is therefore a need for a security anchoring device for signs and the like that addresses the deficiencies in the prior art, such as those discussed above. The present invention is directed toward meeting this need, among others.

SUMMARY OF THE INVENTION

The present invention relates to a security anchoring device attachable to a sign or the like and anchorable to the ground to prevent or discourage theft. According to one aspect of the invention, the security anchoring device includes a coupling member mountable to a member of the sign and also mountable along the shaft of a ground anchor. The ground anchor preferably has a tool engagement portion at its distal end that allows the ground anchor to be coupled to a power or manual driving tool to drive the anchor into the ground.

According to a further aspect of the invention, the security anchoring device has a ground anchor with an auger or drill flight formed at a lower or distal end. The ground anchor extends to a tool engagement portion at its upper or proximal end. The security anchoring device includes a coupling member having a saddle that is positionable on a member of the sign, and the ground anchor is positionable in a through-hole of the saddle. The coupling member further includes a collar formed at least partially around the through-hole and extending around the tool engagement portion when the tool engagement portion of the ground anchor is seated on or near the saddle. A locking device is placed through the at least one hole of the collar to prevent access to the tool engagement portion and also prevents sliding movement of the coupling member along the ground anchor.

According to another aspect of the present invention, a method for securing and anchoring a sign to the ground is provided. The method includes placing a saddle of a coupling member on a member of the sign. The coupling member includes a collar that extends upwardly from the saddle. A ground anchor is positioned in a through-hole of the saddle with the distal end of the ground anchor on the ground surface. A driving tool is placed on a tool engagement portion at the proximal end of the ground anchor order to drive the ground anchor into the ground until the tool engagement portion is positioned in the collar. A locking device can then be placed through at least one hole in the collar to prevent access to the tool engagement portion. When it is desired for the sign to be removed by an authorized user, the locking device is removed to provide access to the tool engagement portion of the ground anchor, and further to allow the coupling member to slide along the shaft of the anchor as the anchor is removed from the ground.

These and other objects, advantages, forms, features, embodiments, and aspects of the present invention can be further discerned from the following description of the illustrated embodiments.

BRIEF DESCRIPTION OF THE DRAWINGS

FIG. 1 is a perspective view of a security anchoring device according to the present invention coupled to a sign.

FIG. 2 is an end elevational view of a coupling member comprising a portion of the security anchoring device of FIG. 1.

FIG. 3 is a top plan view of the coupling member of FIG. 2.

FIG. 4 is a bottom plan view of the coupling member of FIG. 2.

DESCRIPTION OF THE PREFERRED EMBODIMENT

Figure 6:
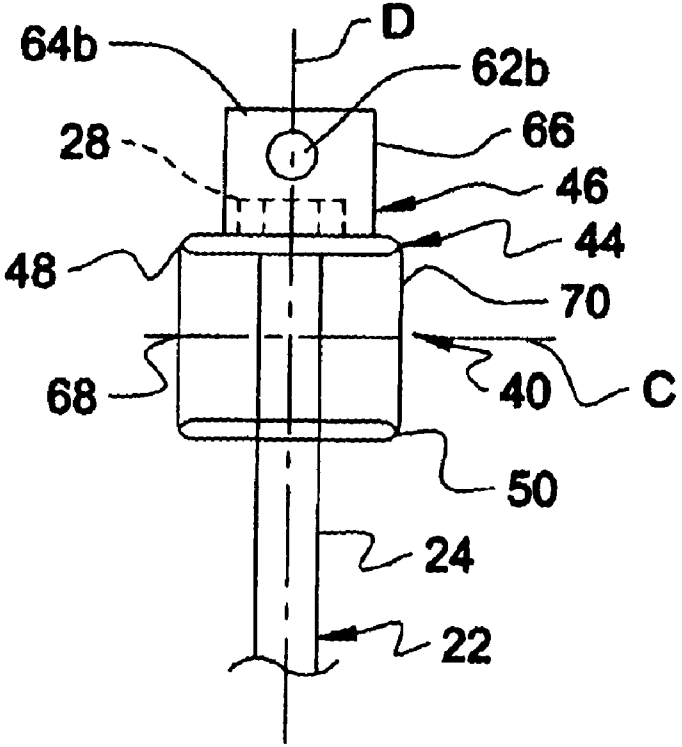
FIG. 6 is a right hand side elevational view of the coupling member of FIG. 2 after it is placed on the ground anchor.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated therein being contemplated as would normally occur to one skilled in the art to which the invention relates.

Referring to FIG. 1, there is illustrated a security anchoring device according to the present invention, indicated generally at 20, for anchoring and securing a sign 10 to ground G. Security anchoring device 20 includes a ground anchor 22, a locking device 30, and a coupling member 40 that is adapted to couple sign 10 to ground anchor 22. In the illustrated embodiment, sign 10 includes side support members 12 and 14 and a cross member 16 extending between side support members 12 and 14. Cross member 16 can be normally provided with sign 10, or can be a member that is attached to the sign for the purpose of coupling sign 10 to security anchoring device 20. Positioned above cross member 16 is display area 18 for displaying a message, advertisement, or the like. Side support members 12, 14 can have lower ends that are positionable into or supported on ground G.

It is well-known that outdoor devices and signs such as sign 10 cannot always be adequately secured or anchored by simply inserting the lower ends of its support members into ground G. Other types of signs and outdoor items are designed to simply rest on the ground surface, and are thus even more easily stolen or knocked over by vandalism, wind, or the like. Security anchoring device 20 can be coupled to a sign or outdoor item and anchored into ground G to prevent or discourage such problems.

Ground anchor 22 includes a shaft 24 extending upwardly from a pointed distal tip 23. Mounted upon or formed integrally with shaft 24 adjacent distal tip 23 is at least one auger, screw, or drill flight 26. At the upper end of ground anchor 22 there is a tool engagement portion 28 (FIG. 5) that is configured to engage a driving tool, such as a drill, T-bar, or any other driving tool known to those skilled in the art, in order to drive ground anchor 22 into ground G. Shaft 24 can be provided with any such structure that pulls shaft 24 down into the ground as it is rotated about its longitudinal axis. This is particularly useful if it is to be driven into relatively hard and compacted soil, or when shaft 24 is to be driven to a relatively great depth below the ground surface.

Although auger 26 of anchor 22 is illustrated as executing a spiral of approximately 360 degrees, the present invention contemplates the use of an auger 26 which does not execute a full revolution, or which executes multiple revolutions about shaft 24. The present invention further contemplates the use of a shaft 24 having a screw thread formed integrally therewith in place of or in addition to auger 26. Other embodiments contemplate that no such auger or screw device is provided on shaft 24, and that ground anchor 22 is driven into ground G by application of an impaction driving force to tool engagement end 28.

Figure 5:
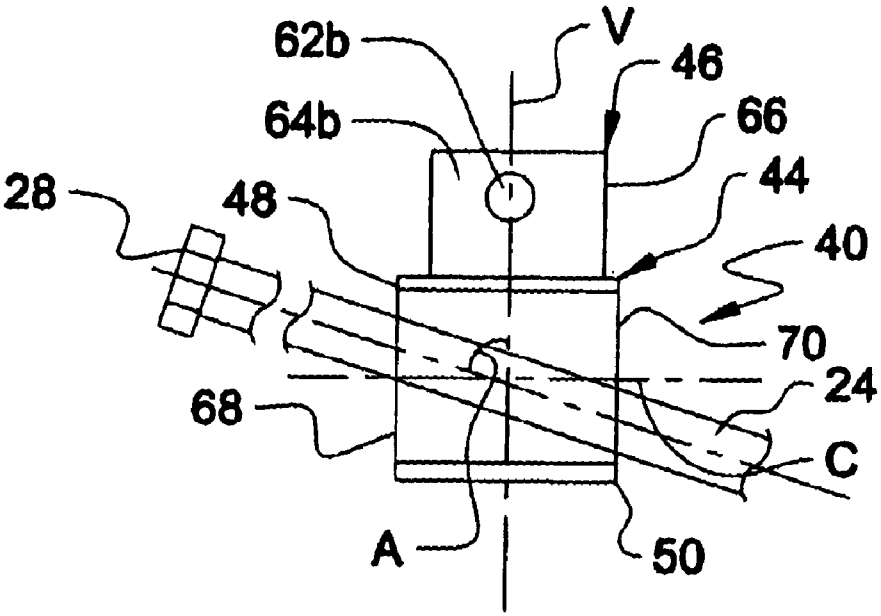
FIG. 5 is a right hand side elevational view of the coupling member of FIG. 2 as it is being placed on a ground anchor.

Tool engagement portion 28 is shown in FIGS. 5 and 6 as an enlarged nut or end member that is integrally formed with shaft 24. However, any configuration for tool engagement portion 28 is contemplated herein as would occur to those skilled in the art. For example, tool engagement portion could be a square head, a hex head, an eyelet, an enlarged head for receiving an impaction force, or a through hole for a cotter pin. Tool engagement portion 28 could also be a female receptacle configured to receive a driving tool therein.

Security anchoring device 20 of FIG. 1 further includes coupling member 40 to couple ground anchor 22 to sign 10. In the illustrated embodiment, coupling member 40 can be placed on cross member 16 at any position along the length of cross member 16 between support members 12, 14. The relative position between sign 10 and ground anchor 22 can thus be adjusted along the length of cross member 16 before or after ground anchor 22 is secured to ground G. It is further contemplated that coupling member 40 can be permanently affixed to cross member 16 via welding or the like.

Referring now to FIGS. 2–4, coupling member 40 will be further described. Coupling member 40 includes a U-shaped saddle 44 having a top plate 48, a bottom plate 50 spaced from and extending substantially parallel to top plate 48, and an endwall 52 extending therebetween. In the illustrated embodiment, endwall 52 is convexly curved between top plate 48 and bottom plate 50. However, endwall 52 can be formed with any shape so long as it extends between top plate 48 and bottom plate 50. A collar 46 is engaged to and extends from top plate 48 of saddle 46. Saddle 44 forms a receiving portion 60 adjacent endwall 52 and between top plate 48 and bottom plate 50 that is sized to receive cross member 16 of sign 10. Opposite end wall 52, top plate 48 has terminal end 49 and bottom plate 50 has terminal end 51. A gap is formed between terminal ends 49 and 51 in communication with receiving portion 60 and sized to allow passage of cross member 16 therethrough and into receiving portion 60 adjacent end wall 52.

Saddle 44 further includes a top slot 54 formed in top plate 48 extending parallel to and in the direction of slot axis D, and a bottom slot 56 formed in bottom plate 50 extending parallel to and in the direction of slot axis D. As shown in FIG. 3, top slot 54 opens at a first side 68 of saddle member 44 and extends toward a second side 70 beyond a center axis C of saddle 44. As shown in FIG. 4, bottom slot 56 is open at a second side 70 of saddle member 44 and extends toward first side 68 beyond center axis C. Top slot 54 and bottom slot 56 have an overlap region forming a through-hole 58 in saddle 44. Through-hole 58 is sized to accommodate shaft 24 so that shaft 24 is alignable with a central vertical axis V formed at the intersection of slot axis D and center axis C of saddle 44. Further, top plate member 48 and bottom plate member 50 each have a length sufficient to extend beyond cross member 16 when it is positioned in receiving portion 60 so that cross member 16 does not block through-hole 58.

Collar 46 is engaged to top plate 48 of saddle 44 and extends upwardly therefrom when coupling member 40 is oriented on cross member 16 as shown in FIG. 1. In the illustrated embodiment, collar 46 has a semi-circular shaped wall that is formed around at least a portion of top slot 54 and is open towards first side 68 of saddle 44. Collar 46 has a pair of opposite sidewalls 64*a*, 64*b* and an endwall 66 extending between sidewalls 64*a*, 64*b* forming a U-shaped receptacle that is sized to receive tool engagement portion 28 of ground anchor 22 therein. Preferably, sidewalls 64*a*, 64*b* extend beyond center axis C, and sidewalls 64*a*, 64*b* each include a hole 62*a*, 62*b*, respectively, formed therethrough. When locking device 30 is placed in holes 62*a*, 62*b* as shown in FIG. 1, a portion of locking device 30 preferably at least partially extends over through-hole 58 and tool engagement end 28 when ground anchor 22 is positioned in through-hole 58 as shown in FIG. 6.

According to one preferred method of using the present invention, support members 12, 14 of sign 10 are secured into or placed on ground G. Coupling member 40 is placed on cross member 16 of sign 10 so that cross member 16 is positioned in receiving portion 60. As shown in FIG. 5, ground anchor 22 is then mounted onto saddle 44 by placing shaft 24 into the gap between top plate 48 and bottom plate 50 after orienting shaft 24 transversely to vertical axis V. In one form of the invention, it is contemplated that this initial orientation results in an angle A in the range of 45 to 90 degrees. Shaft 24 is then positioned in saddle 44 so that it is aligned with the opening of top slot 54 along first side 68 and the opening of bottom slot 56 along second side 70. Anchor 22 can then be rotated into slots 54, 56 to position shaft 24 into top slot 54 and bottom slot 56, and further rotated to orient shaft 24 along vertical axis V and positioning shaft 24 in through-hole 58 as shown in FIG. 6.

Shaft 24 is slidable with respect to coupling member 40 to position distal tip 23 on the ground surface. In this position, shaft 24 extends alongside display portion 18 of sign 10. Since shaft 24 is slidable along coupling member 40, and coupling member 40 is slidable along cross member 16, sign 10 and ground anchor 22 can be repositioned if necessary after shaft 24 is inserted into through-hole 58. When the desired positioning is obtained, ground anchor 22 is driven into ground G by attaching a driving tool such as a T-bar, handle, power tool, or rotating shaft to tool engagement portion 28. Rotation of ground anchor 22 forces the auger blade or drill flight 26 into ground G. Ground anchor 22 is driven into ground G a sufficient depth so that tool engagement portion 28 is positioned adjacent to or against top plate 48 and in collar 46, as shown in FIG. 6. A retaining element 36 of locking device 30 is then placed through one or both of holes 62*a*, 62*b* to prevent access to tool engagement portion 28 and also to prevent sliding movement of coupling member 40 along shaft 24 should sign 10 become removed or dislodged from ground G.

One alternate method contemplates that ground anchor 22 is positioned on or partially driven into ground G before coupling member 40 is placed on shaft 24. Coupling member 40 is placed on cross member 16 to position cross member 16 in receiving portion 60. Sign 10 is rotated to position vertical axis V of coupling member 40 transverse to shaft 24 and to allow insertion of shaft 24 into slots 54, 56 as discussed above. Sign 10 is then rotated to position shaft 24 into through-hole 58 and align shaft 24 along vertical axis V. Ground anchor 22 is then driven into ground G until tool engagement portion 28 is positioned in collar 46 so that locking device 30 can be, attached to collar 46 as described above.

Further embodiments of security anchoring device 20 contemplate that saddle 44 is not provided with top slot 54 and bottom slot 56. Rather, saddle 44 is provided with aligned top and bottom holes that form a through-hole in saddle 44 in the same position as through-hole 58 defined by the overlap between top slot 54 and bottom slot 56. In this embodiment, engagement portion 28 is provided with a through-hole for a cotter pin, or an attachable cap that provides a nut, eyelet, or the like for engagement with a driving tool. As discussed in the above alternate method, distal end 23 of ground anchor 22 is positioned on or partially driven into ground G. Coupling member 40 is placed on cross member 16 of sign 10. Coupling member 40 is then placed onto shaft 24 by placing through-hole 58 over the proximal end of ground anchor 22. The attachable engagement portion is then placed on the upper or proximal end of ground anchor 22, and ground anchor 22 is driven into the ground until the attachable tool engagement portion is positioned in collar 46 as described above.

Although locking device 30 is illustrated in FIG. 1 as being locked to coupling member 40 by means of a padlock 34, the present invention comprehends the use of any structure or device to lock the anchor 22 to coupling member 40. Examples of other locking devices include a bolt and nut which, although not a lock, the bolt/nut combination could require special tools or other features to deter removal, thereby deterring most would-be thieves and vandals. Other types of locking devices may also be used, such as a cotter pin, a length of wire, chain and padlock, and the like.

Ground anchor 22 of security anchoring device 20 prevents sign from being lifted straight out of the ground due to the interaction between the soil and the auger 26 and/or frictional engagement with the shaft. Therefore, the sign may not be removed until locking device 30 is removed to allow tool access to engagement portion 28 of ground anchor 22, thereby allowing a tool to be attached to ground anchor 22 to remove it from ground G. This greatly discourages sign theft and vandalism. Further, if the sign were to become dislodged from the ground, security anchoring device 20 prevents the sign from falling down, and can remain in its upright position if cross member 16 were non-rotatable with respect to saddle 44.

It will be appreciated that while the security anchoring device 20 of FIG. 1 is suitable for the secure mounting of a sign or the like, there are numerous other uses. Because the security anchoring device of the present invention forms a securely anchored post into the ground that is not easily removed, the security anchoring device of the present invention may be coupled to anything that is desired to be anchored. For instance, the security anchoring device of the present invention can be attached to park benches, picnic tables, portable grills, garbage cans, and other items that may be accessible to the public in order to prevent the unauthorized removal or vandalism of these items.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A security anchoring device for an outdoor item, comprising:

a ground anchor having a shaft extending between a first end and a second end, said shaft being adapted toward said first end for placement in the ground and said second end including a tool engagement portion;

a coupling member including:

a saddle having a through-hole to slidably position said coupling member on said shaft of said ground anchor, wherein said saddle is adjustably positionable on said shaft of said ground anchor; and a collar at; least partially around said through-hole extending from said saddle, said collar including at least one hole for receiving a locking device therethrough, whereby said collar is sized to receive said tool engagement portion therein.

2. The security anchoring device of claim 1, wherein said locking device includes a portion adapted to pass through said at least one hole in said collar thereby preventing access to said tool engagement portion and prevent sliding movement of said coupling member on said shaft.

3. The security anchoring device of claim 2, wherein said locking device is selected from the group comprising: a padlock, a chain, a wire, a nut and a bolt, and a cotter pin.

4. The security anchoring device of claim 1, wherein said adapted portion of said shaft includes a generally spiraled surface selected from the group comprising: a drill flight, an auger, and a screw thread.

5. The security anchoring device of claim 1, wherein said tool engagement portion at said second end of said ground anchor is selected from the group comprising: a nut, an attachable cap, a through-hole and an eyelet.

6. The security anchoring device of claim 1, wherein said saddle has a receiving portion for receiving a horizontal cross member of the outdoor item prior to positioning said shaft of said ground anchor in said through-hole.

7. The security anchoring device of claim 6, wherein said saddle includes:

a top plate;

a bottom plate-spaced from and generally parallel to said top plate; and an endwall extending between said top plate and said bottom plate, said receiving portion adjacent said endwall and being defined by said endwall and said top and bottom plates, said receiving portion being open opposite said endwall for positioning the outdoor item therein.

8. The security anchoring device of claim 7, wherein said endwall is convexly curved between said top plate and said bottom plate.

9. The security anchoring device of claim 7, wherein:

said top plate includes a top slot opening at a first side of said saddle; and said bottom plate includes a bottom slot opening at a second side of said saddle opposite said first side, wherein said top and bottom slots have an overlap region defining said through-hole.

10. The security anchoring device of claim 1, wherein said collar is U-shaped.

11. The security anchoring device of claim 1, wherein:

said saddle includes a top slot opening at a first side thereof; and said saddle includes a bottom slot opening at a second side thereof opposite said first side, wherein said top and bottom slots have an overlap region defining said through-hole.

12. The security anchoring device of claim 1, wherein:

said saddle includes a receiving portion for receiving a member of the outdoor item therein between a top plate and a bottom plate of said saddle;

said collar extends from said top plate opposite said receiving portion; and said shaft-extends through said receiving portion with said tool engagement. portion positioned in said collar.

13. A security anchoring device for an outdoor item, comprising:

a ground anchor having a shaft extending between a first end and a second end, said shaft being adapted toward said first end for placement in the ground and said second end including a tool engagement portion;

a coupling member including:

a saddle having a through-hole to slidably position said coupling member on said shaft of said ground anchor, said saddle including a receiving portion for receiving a horizontal cross member of the outdoor item prior to positioning said shaft of said ground anchor in said through-hole, wherein said saddle includes:

a top plate;

a bottom plate spaced from and generally parallel to said top plate; and an endwall extending between said top plate and said bottom plate, said receiving portion adjacent said endwall and being defined by said endwall and said top and bottom plates, said receiving portion being open opposite said endwall for positioning the outdoor item therein; and a collar at least partially around said through-hole extending from said saddle, said collar including at least one hole for receiving a locking device therethrough, whereby said collar is sized to receive said tool engagement portion therein.

14. The security anchoring device of claim 13, wherein said locking device includes a portion adapted to pass through said at least one hole in said collar thereby preventing access to said tool engagement portion and prevent sliding movement of said coupling member on said shaft.

15. The security anchoring device of claim 13, wherein said endwall is convexly curved between said top plate and said bottom plate.

16. The security anchoring device of claim 13, wherein:

said top plate includes a top slot opening at a first side of said saddle; and said bottom plate includes a bottom slot opening at a second side of said saddle opposite said first side, wherein said top and bottom slots have an overlap region defining said through-hole.

17. The security anchoring device of claim 13, wherein:

said saddle includes a top slot opening at a first side thereof; and said saddle includes a bottom slot opening at a second side thereof opposite said first side, wherein said top and bottom slots have an overlap region defining said through-hole.

18. A security anchoring device for an outdoor item, comprising:

a ground anchor having a shaft extending between a first end and a second end, said shaft being adapted toward said first end for placement in the ground and said second end including a tool engagement portion;

a coupling member including:

a saddle defining a receiving portion and having a through-hole formed therethrough to slidably position said coupling member on said shaft of said ground anchor, said through hole being formed by an overlap region between a top slot opening at a first side of said saddle and a second slot opening at a second side of said saddle, wherein said saddle is adjustably positionable on said shaft of said ground anchor; and a collar at least partially around said through-hole extending from said saddle, said collar including at least one hole for receiving locking means therethrough.

19. The security anchoring device of claim 18, further comprising means for locking said coupling member to the outdoor item.

20. The security anchoring device of claim 19, wherein said collar is sized to receive said tool engagement portion therein.

21. The security anchoring device of claim 20, wherein said means for locking substantially blocks access to said tool engagement portion of said ground anchor when said tool engagement portion is positioned in said collar.

22. The security anchoring device of claim 18, wherein said saddle includes:

a top plate having said top slot formed therein;

a bottom plate having said bottom slot formed therein; and an endwall extending between said top plate and said bottom plate.

* * * * *

UNITED STATES PATENT AND TRADEMARK OFFICE

CERTIFICATE OF CORRECTION

PATENT NO. : 6,629,389 B1
DATED : October 7, 2003
INVENTOR(S) : Marcus D. Rust

It is certified that error appears in the above-identified patent and that said Letters Patent is hereby corrected as shown below:

Column 6,
Line 57, please change “at;” to -- at --.

Column 7,
Line 14, please change “plate-spaced” to -- plate spaced --.

Signed and Sealed this

Twentieth Day of July, 2004

JON W. DUDAS
*Acting Director of the United States Patent and Trademark Office*